US005867842A

United States Patent [19]

Pinsley et al.

[11] Patent Number: 5,867,842

[45] Date of Patent: Feb. 9, 1999

[54] PROTECTIVE INFLATABLE VEST

[76] Inventors: Sherri Wallis Pinsley, 18456 SE. Heritage Dr., Tequesta, Fla. 33469; Alan T. Fletcher, 950 Westview Dr., Boulder, Colo. 80303; James E. Strauch, P.O. Box 202, Mead, Colo. 80542-0202

[21] Appl. No.: 903,612

[22] Filed: Jul. 31, 1997

[51] Int. Cl.[6] ..... A41D 13/00

[52] U.S. Cl. ..... 2/462; 2/463; 2/467; 2/DIG. 3; 280/730.1; 280/737

[58] Field of Search ..... 2/463, DIG. 3, 2/46, 92, 455, 456, 462, 465, 102; 441/92, 90, 96; 280/730.1, 733, 737

[56] References Cited

U.S. PATENT DOCUMENTS

| | | | |
|---|---|---|---|
| 3,709,044 | 1/1973 | Chacko | 74/2 |
| 3,788,596 | 1/1974 | Maeda | 280/150 |
| 4,137,585 | 2/1979 | Wright | 9/314 |
| 4,203,616 | 5/1980 | Okada | 280/737 |
| 4,825,469 | 5/1989 | Kincheloe | 2/DIG. 3 |
| 5,026,310 | 6/1991 | Mackal et al. | 441/93 |
| 5,500,952 | 3/1996 | Keyes | 2/2 |
| 5,535,446 | 7/1996 | Pusic | 2/2 |
| 5,746,442 | 5/1998 | Hoyaukin | 280/730.1 |

FOREIGN PATENT DOCUMENTS 3616890 11/1997 Denmark .

*Primary Examiner*—Michael A. Neas
*Assistant Examiner*—Tejash D. Patel
*Attorney, Agent, or Firm*—Robert M. Downey, P.A.

[57] ABSTRACT

An impact absorbing garment is shown having a number of inflatable compartments attached to the garment. A source of pressurized gas is mounted to a manifold assembly also attached to the garment. The manifold assembly includes internal passageways connecting a gas inlet that receives gas from the source of pressurized gas to a gas outlet. Tubing attached to the garment connects the manifold assembly gas outlet to the inflatable compartments. The manifold assembly also houses a gas release valve. A toggle link mechanism supported within the manifold assembly provides a mechanical advantage by reducing the force required to maintain the gas release valve in a closed position against high pressure gas at the gas inlet. An electric solenoid moves a slide member to release the toggle link mechanism and open the gas release valve when an electrical circuit is closed between the solenoid valve and an electrical power source attached to the garment. Interlock switches are provided as part of the vest closures, and a tilt switch for sensing abnormal positions of the wearer of the garment completes the electrical circuit.

20 Claims, 12 Drawing Sheets

FIG. 5
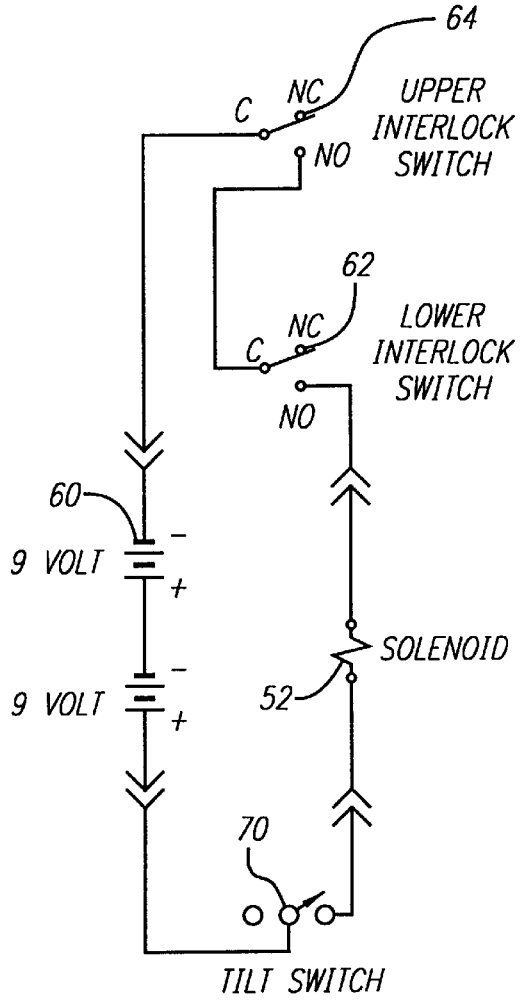
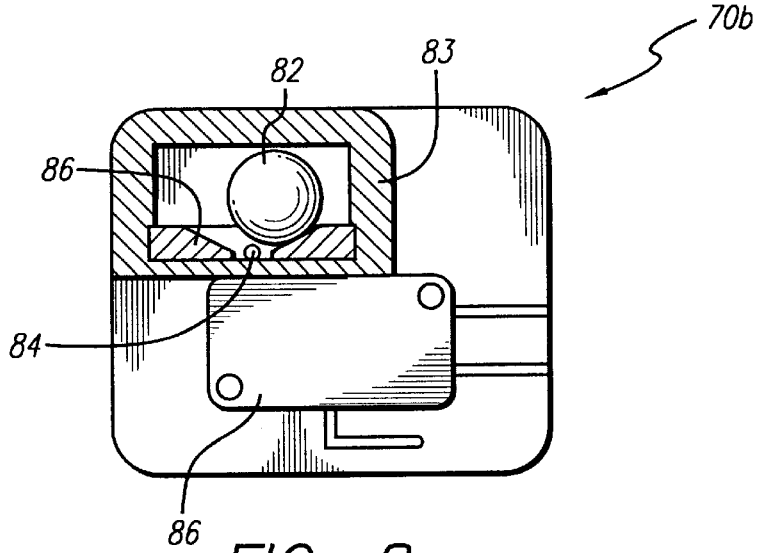
FIG. 8

PROTECTIVE INFLATABLE VEST

BACKGROUND OF THE INVENTION

1. Field of the Invention

This invention relates to an impact absorbing piece of clothing that can be used to protect an individual wearing the clothing.

2. Description of the Related Art

Garments, such as vests, have been proposed wherein the garment contains one or more inflatable air bags positioned to surround the wearer when inflated and to protect the wearer during impact from a fall or collision. Protective garments, such as that shown in U.S. Pat. No. 4,977,623, are not completely self-contained, requiring the presence of external crash sensors. An example of another inflatable garment is shown in U.S. Pat. No. 4,685,151. This garment requires the presence of an external source of pressurized gas that is connected to the garment through a long tube.

Similarly, in U.S. Pat. No. 4,637,074, a protective garment is shown having inflatable envelopes attached to the garment and a source of pressurized gas separate from the garment that is connected through a tube.

A disadvantage of all of the existing protective garments is that they are not completely self-contained. A further disadvantage of the existing garments is that they are not provided with a simple means for sensing when the wearer is approaching a position wherein protection from impact will be required, and for effecting the release of high pressure gas into the inflatable compartments of the garment while using only a relatively low voltage portable power source. A further disadvantage of the existing garments is that they are not provided with a means for ensuring that the garment cannot be activated until the garment is properly installed on an individual.

The present invention overcomes the disadvantages of the existing garments by providing a garment that is completely self-contained and that cannot be activated to an inflated condition until it is properly installed on an individual.

A further advantage of the present invention is provided by a compact manifold assembly that can be attached to the vest at various positions and that provides support for pressurized gas canisters, a gas release plunger, a toggle release for the plunger, and a solenoid for activating the toggle release.

SUMMARY OF THE INVENTION

A protective garment according to the present invention is made from a flexible, comfortable material such as a nylon weave that conforms to the shape of a human being and that includes closures for holding the garment about the wearer, and that must be in a closed position before the garment can be activated to a protective inflated state. The garment includes a number of inflatable compartments that are connected through tubing to a source of high pressure gas. A compact manifold assembly is supported on the garment and provides support for pressurized gas canisters as well as a gas release plunger that is normally retained in a closed position by a toggle link and solenoid operated slide assembly. Movement of the slide by the solenoid allows the toggle link to pivot within the manifold assembly, thus releasing the gas release plunger and allowing gas to flow from the pressurized gas canisters through an exit in the manifold assembly to the tubing and the inflatable compartments.

Actuation of the electric solenoid mounted on the manifold assembly can only occur upon the completion of an electrical circuit from a portable source of electric power also mounted on the garment. The electrical circuit providing power from the portable source of power to the electric solenoid includes a special tilt switch for sensing the orientation of the wearer of the garment. The special tilt switch is connected in series to the power source. The special switch is then connected in series through two interlock switches contained within the garment closures to the electric solenoid mounted on the manifold assembly.

An object of the present invention is to provide an impact absorbing piece of clothing that could be worn by an elderly person in order to prevent injury resulting from a fall.

A further object of the present invention is to provide the protective clothing as a completely self-contained unit that can be comfortably worn as the person moves about.

Yet another object of the present invention is to provide a means for ensuring that the garment cannot be activated until it is completely and correctly installed on the wearer.

Still another object is to provide a means for controlling the flow of very high pressure gas while using only a relatively low voltage power source suitable for portability.

These and other objects and advantages of the present invention will become more apparent from the following description when taken in connection with the accompanying drawings which show, for purpose of illustration only, various embodiments in accordance with the present invention.

BRIEF DESCRIPTION OF THE DRAWINGS

For a better understanding of the present invention, reference should be made to the following detailed description taken in conjunction with the drawings in which:

FIG. 5 is a wiring schematic showing the electrical interconnection between the components of the protective vest;

FIG. 8 is a side elevation view in partial cross-section showing a second embodiment of a tilt switch for the present invention;

Like reference numerals refer to like parts throughout the several views of the drawings.

DETAILED DESCRIPTION OF THE PREFERRED EMBODIMENTS

Figure 1:
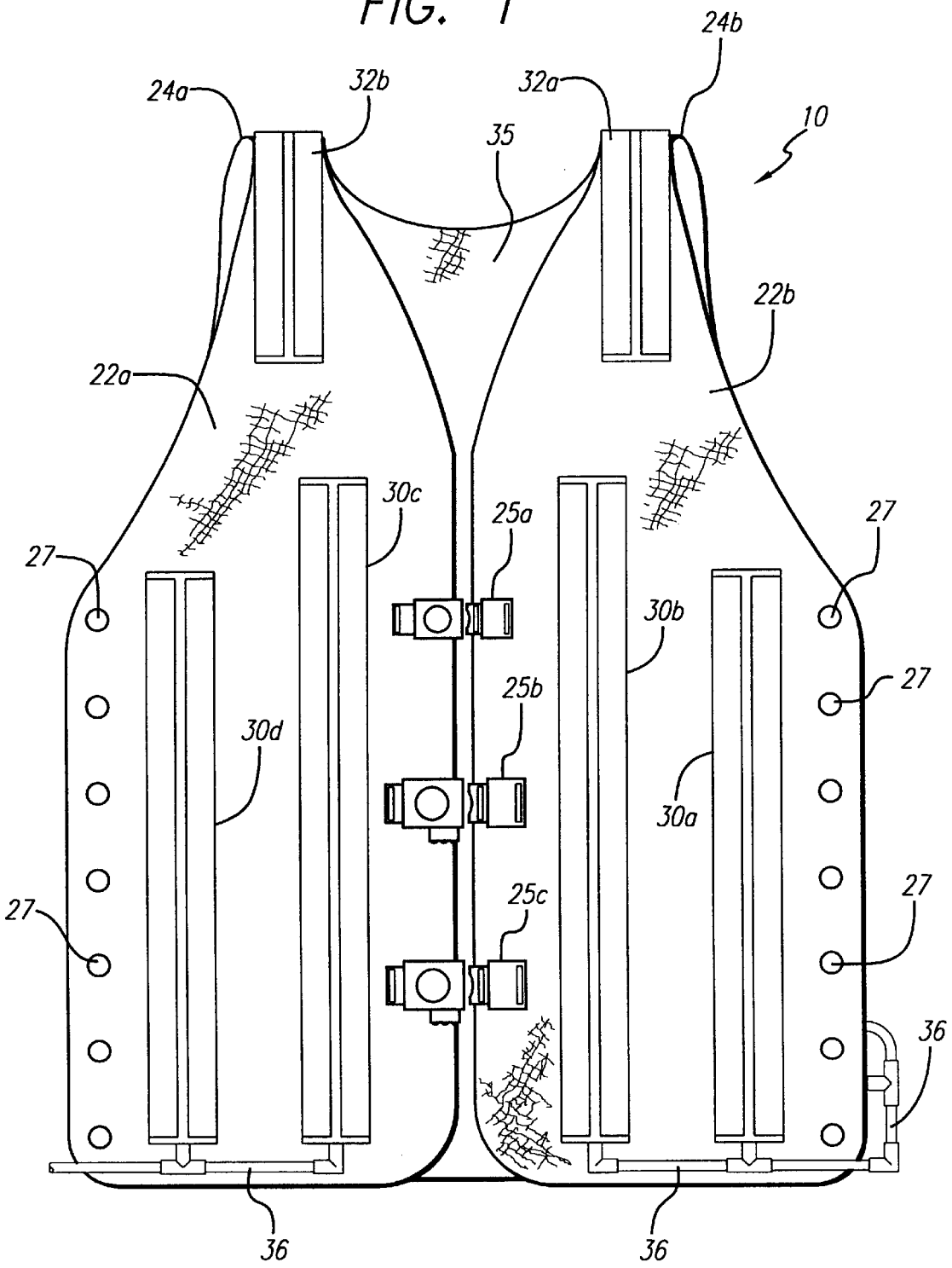
FIG. 1 is a front elevation view of a protective vest according to an embodiment of the present invention.
Figure 2:
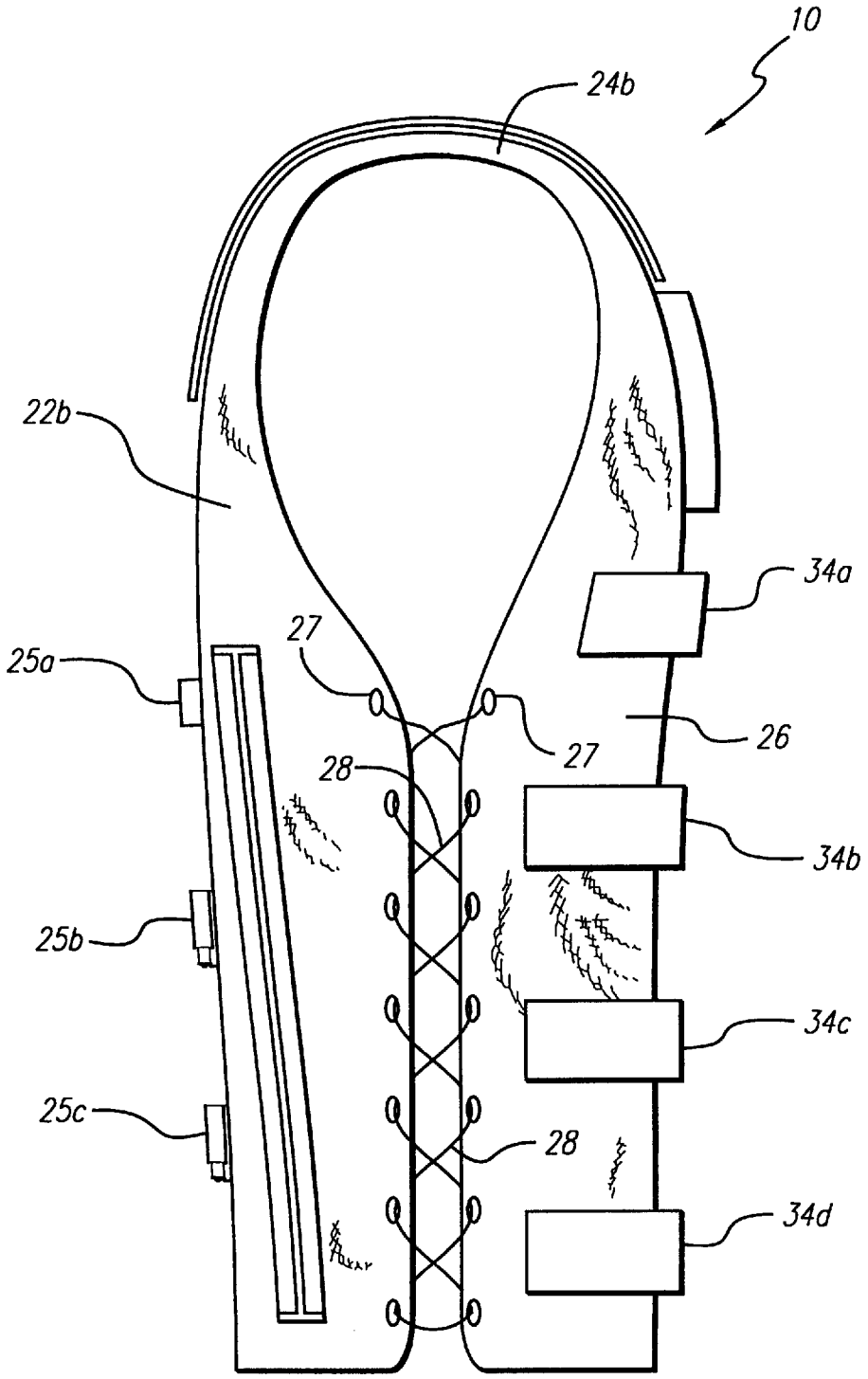
FIG. 2 is a side elevation view of a protective vest according to an embodiment of the present invention.
Figure 3:
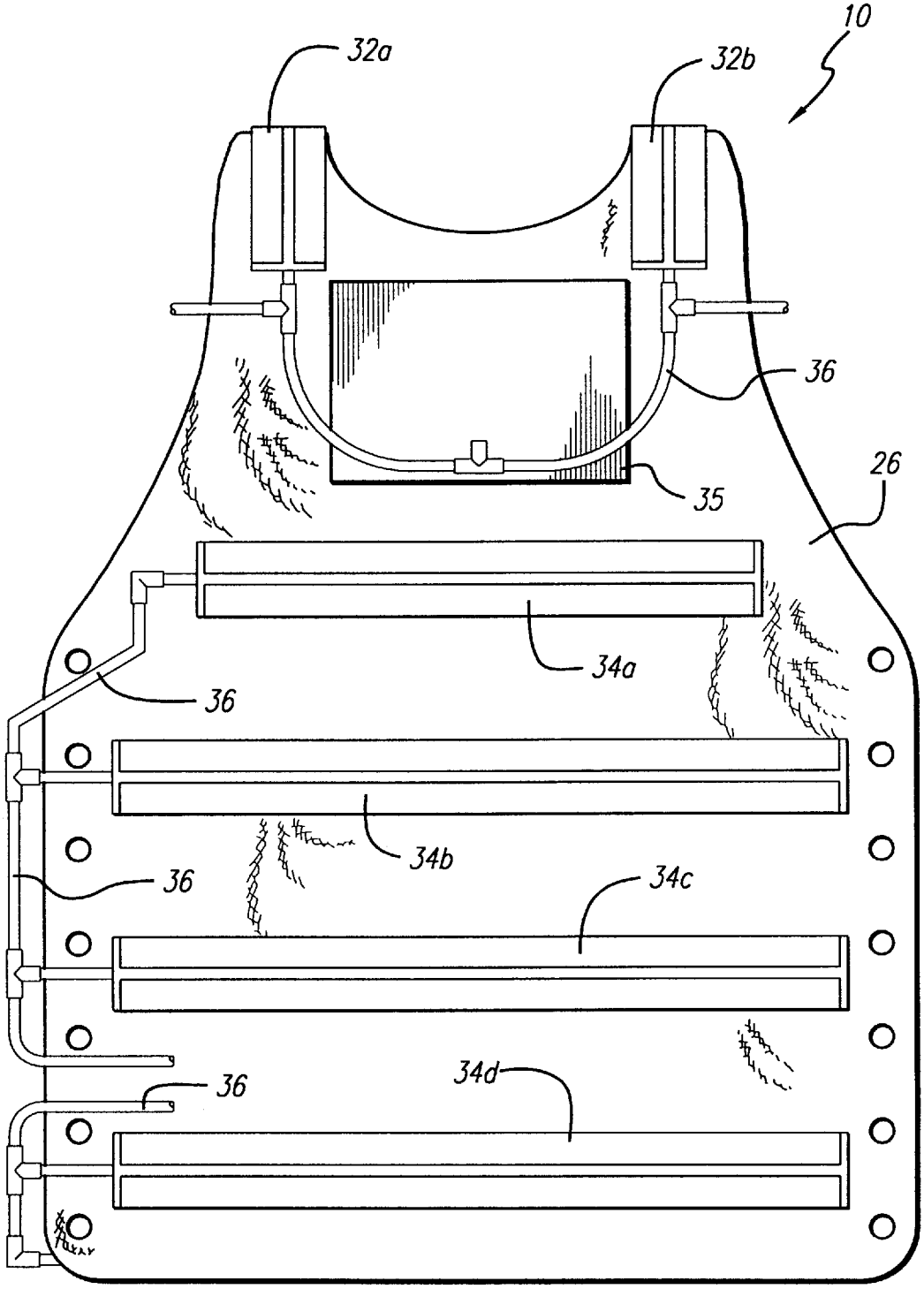
FIG. 3 is a rear elevation view of a protective vest according to an embodiment of the present invention.
Figure 4:
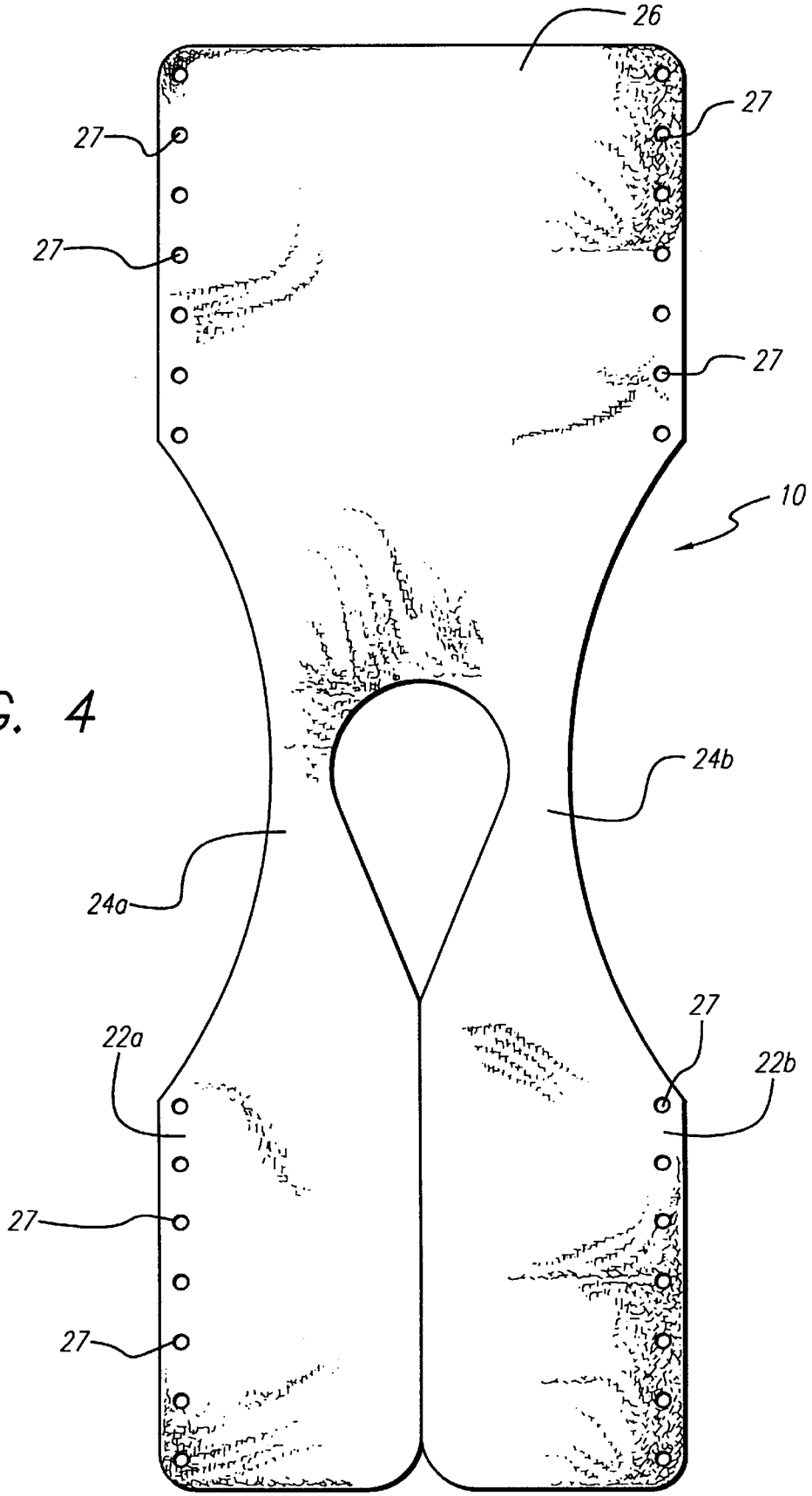
FIG. 4 is a top elevation view of a protective vest according to an embodiment of the present invention wherein the vest is opened up such that front and back panels of the vest lie in a single plane.
Figure 11:
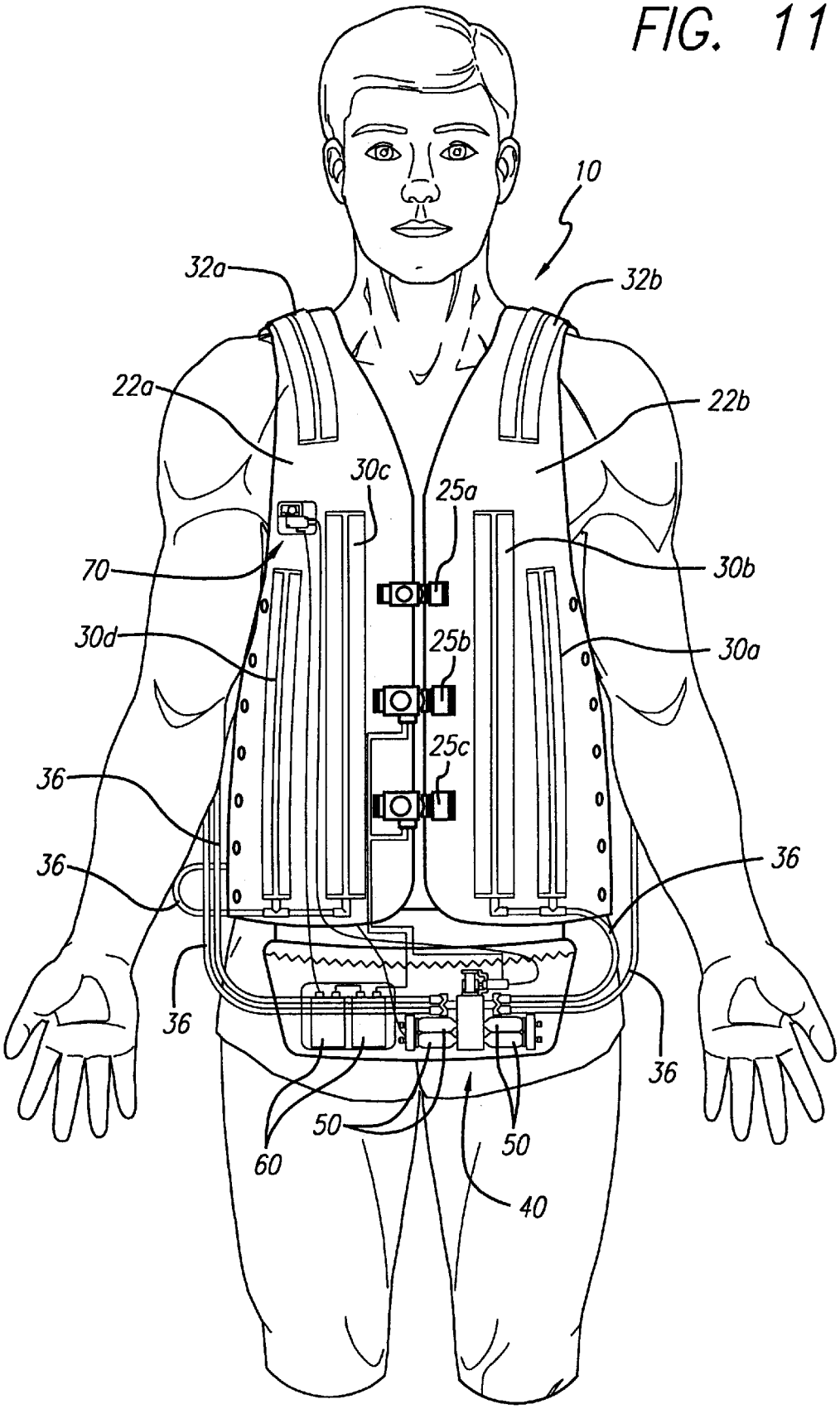
FIG. 11 illustrates a front elevation view of an embodiment of the present invention, showing the batteries, manifold and solenoid assembly and source of pressurized gas mounted within an integral pocket located at the lower front of the vest.
Figure 12:
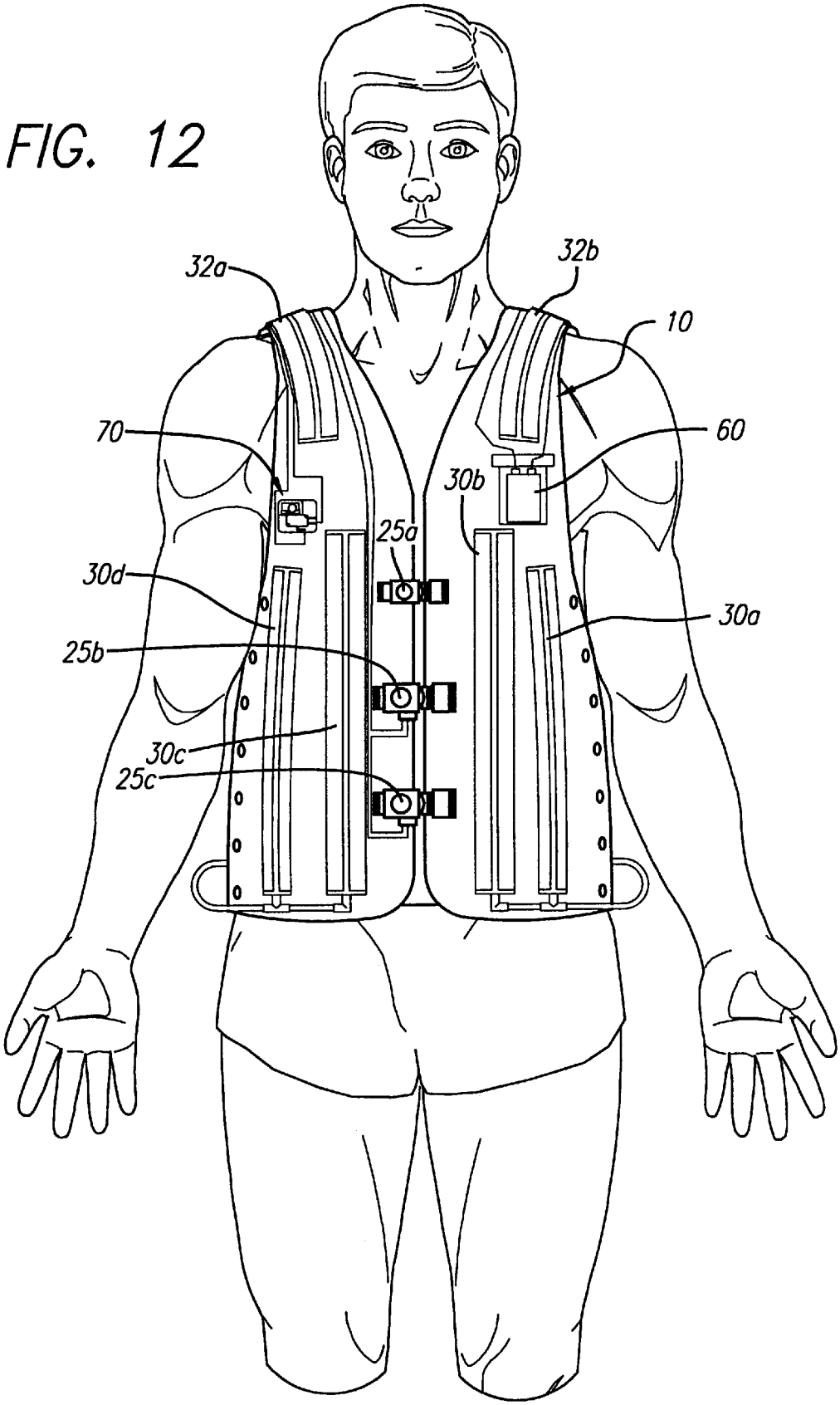
FIG. 12 is a front elevation of another embodiment, showing the tilt switch assembly and batteries carried in pockets on the vest.
Figure 13:
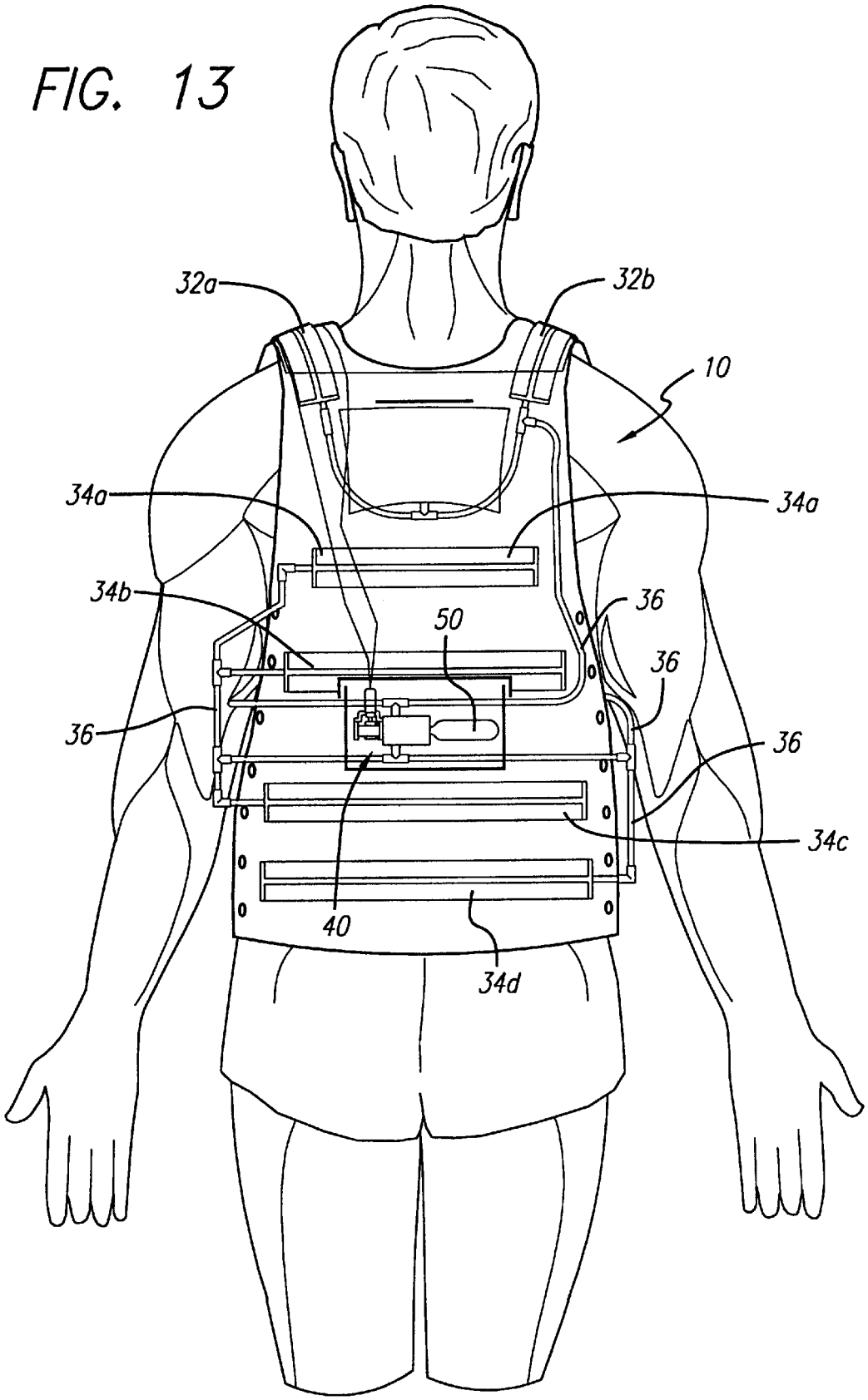
FIG. 13 is a front elevation of still another embodiment, showing the manifold and solenoid assembly carried internally within the mid-section of the vest.

Referring initially to FIGS. 1–4, an embodiment of a protective inflatable vest according to the present invention is shown generally as 10 and includes front panels 22*a* and 22*b* being integrally connected through respective shoulder portions 24*a* and 24*b* to a rear panel 26, best seen in FIG. 3. The panels of the protective vest 10 are preferably made from an open weave material such as a nylon mesh, that provides flexibility, comfort and high strength. Pleated portions of the vest material form housings for inflatable bladders 30*a*, 30*b*, 30*c*, 30*d*, 32*a* and 32*b*, as shown in FIGS. 1, 11 and 12, and inflatable bladders 34*a*, 34*b*, 34*c*, and 34*d*, as shown in FIGS. 3 and 13. Inflatable bladders 32*a* and 32*b* are multi-pleated bladders which when inflated, rise along both sides of the head to protect from side impacts. An inflatable collar portion 35 can also be provided on the vest 10. Inflatable collar portion 35 contains a bladder which when inflated rises behind the head area to protect from rear impacts.

Flexible conduit, or tubing 36, interconnects the inflatable bladders on the vest and a manifold assembly gas outlet 42, best seen in FIGS. 1, 3, 11 and 12.

Figure 9:
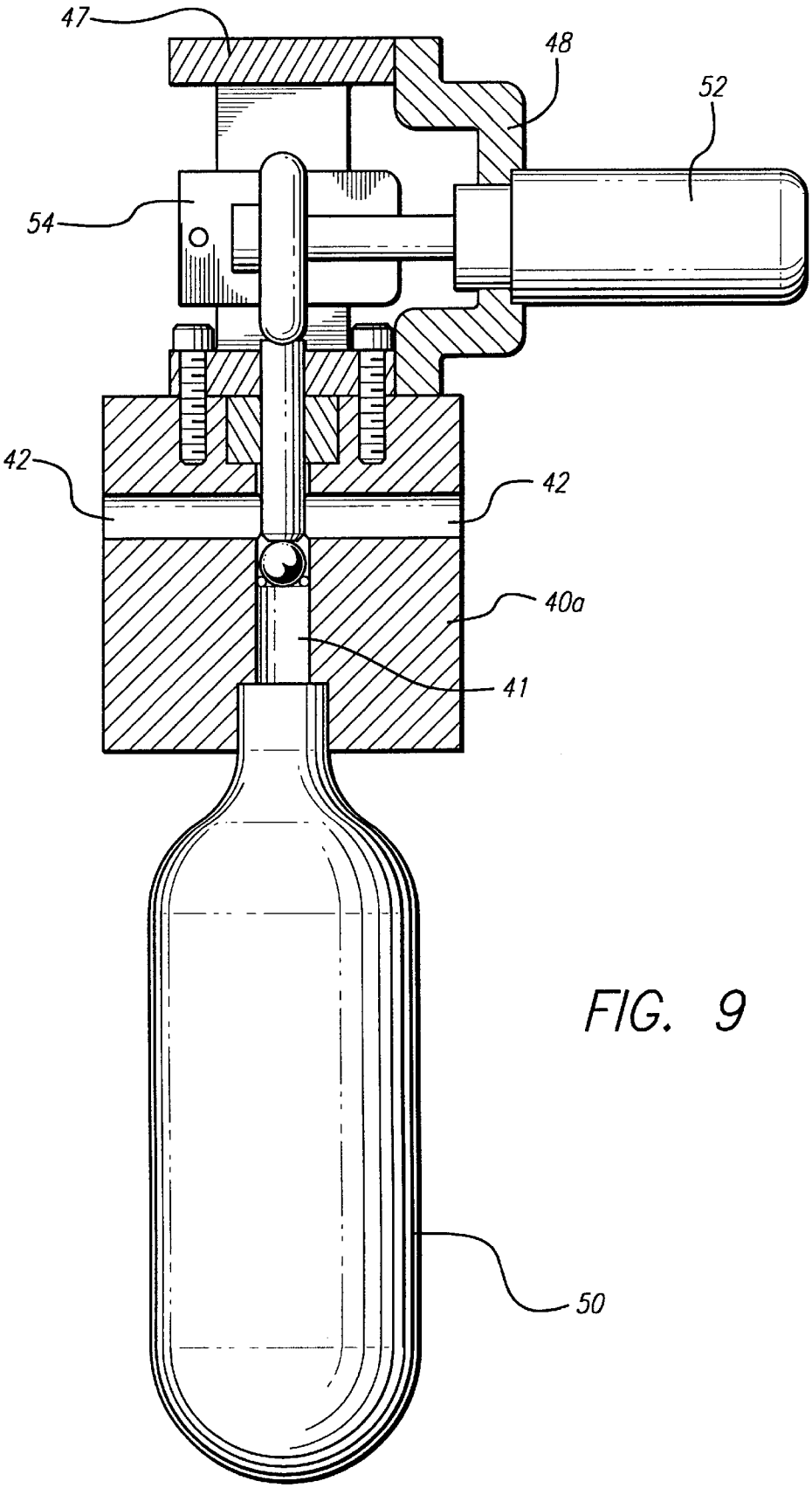
FIG. 9 illustrates a first embodiment of the manifold assembly of the present invention having a single gas canister.

Referring to FIG. 9, a first embodiment of a manifold assembly 40 for the present invention is shown, wherein a main housing 40A is provided with internal passageways connecting a gas inlet 41 to the gas outlets 42. In the embodiment shown in FIG. 9, gas inlet 41 is supplied with high pressure gas from a screw in type gas canister 50 supported by manifold main housing 40*a*. In the embodiment shown in FIG. 10, gas inlet 41 is supplied with high pressure gas from four separate gas canisters 50, all supported by manifold main housing 40*b*.

Referring back to FIGS. 1 and 2, front panel portions 22*a* and 22*b* are shown connected together by vest closures 25*a*, 25*b* and 25*c*. Grommets 27 are provided along side edges of respective front panel portions 22*a* and 22*b* and along side edges of rear panel 26, as best seen in FIG. 2. Lacing material 28 can be interwoven through grommets 27 in order to connect front panels 22*a* and 22*b* to rear panel 26.

Figure 6C:
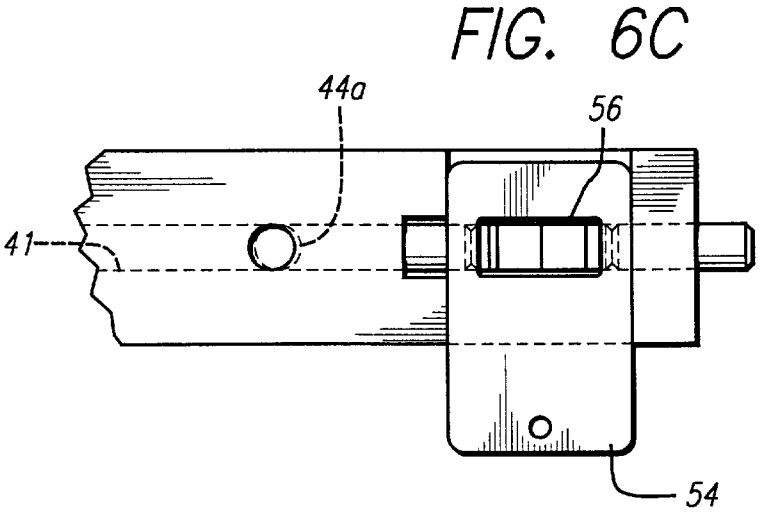
FIG. 6C is a top elevation view of the assembly shown in FIG. 6A when the gas release valve is in an opened position.
Figure 6D:
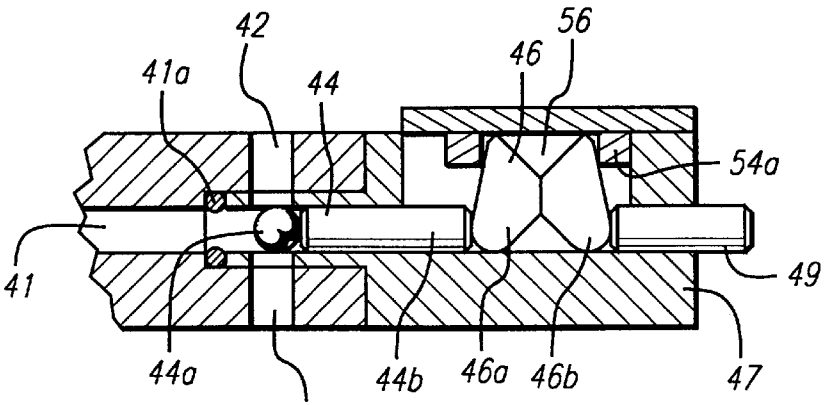
FIG. 6D is a side elevation view of the mechanism shown in FIG. 6C, illustrating the toggle link mechanism having entered into an opening in the slide member.
Figure 6A:
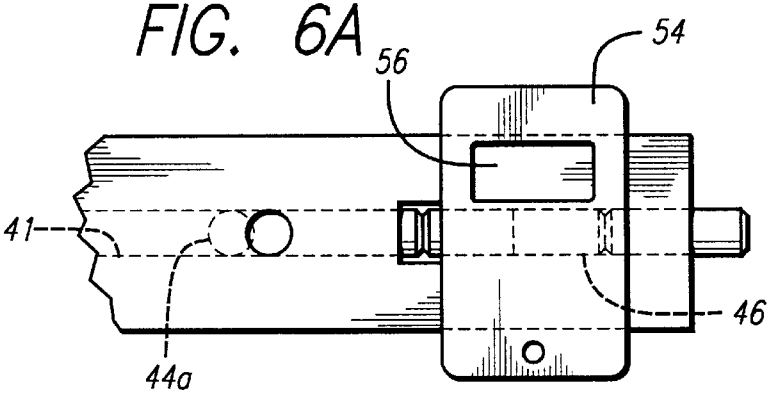
FIG. 6A is a top elevation view of a portion of the manifold assembly of the present invention showing the gas release valve and slide member of the toggle link mechanism when the gas release valve is in a closed position.
Figure 6B:
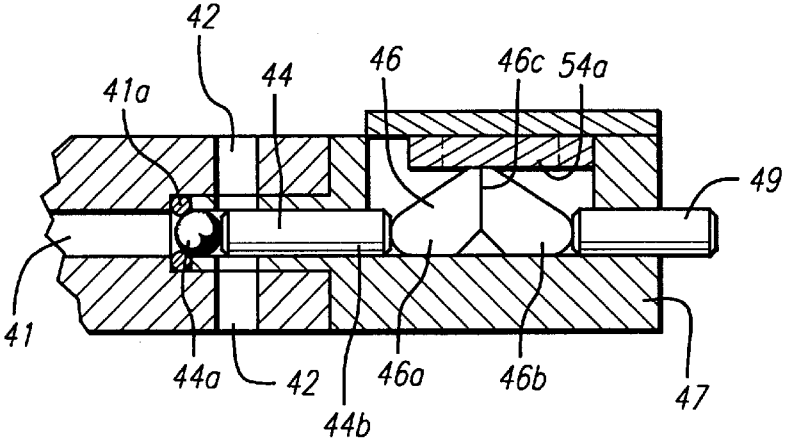
FIG. 6B is a side elevation view of a portion of the manifold assembly of the present invention showing the gas release valve and toggle link mechanism when the gas release valve is in a closed position.
Figure 10:
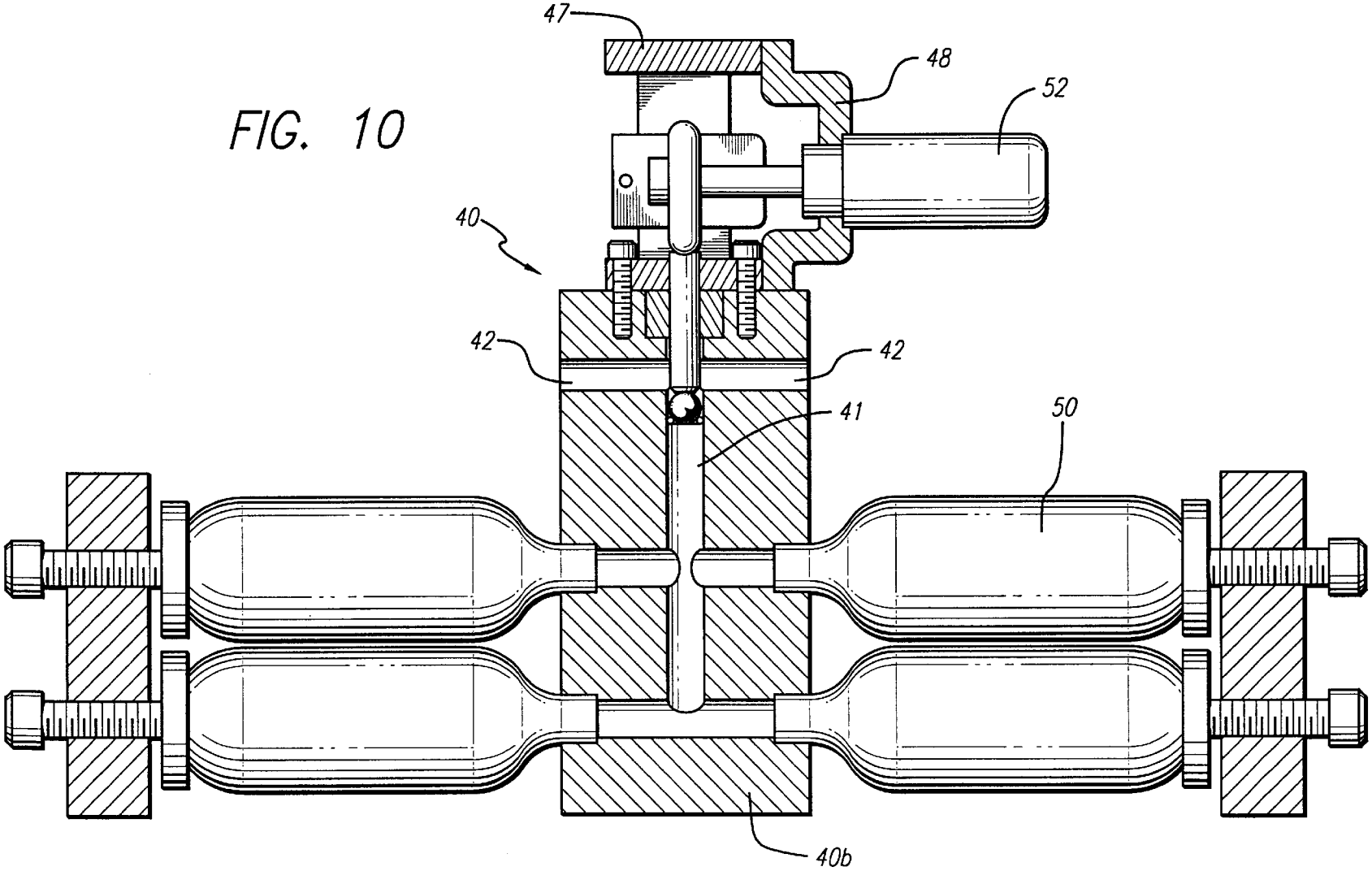
FIG. 10 illustrates a second embodiment of the manifold assembly of the present invention having four gas canisters.

The flow of high pressure gas from gas canisters 50 through gas conduit 36 to the inflatable bladders supported on the vest is controlled by a gas release valve 44, best seen in FIGS. 6B and 6D, in combination with a toggle link 46 and an electric solenoid 52, best seen in FIGS. 9 and 10.

Gas release valve 44 includes a ball 44*a* and a plunger 44*b* slidably supported within an internal passageway through manifold assembly main housing 40*a* as shown in FIG. 9, or manifold assembly main housing 40*b* as shown in FIG. 10. As best seen in FIG. 6B, ball 44*a* seals against an O-ring seat 41*a* when gas release valve 44 is in a closed position. As best seen in FIG. 6D, ball 44*a* and plunger 44*b* slide along the internal passageway in manifold assembly main housing 40*a* or 40*b* in order to open up a passageway between gas inlet 41 and gas outlets 42.

Toggle mechanism housing 47, best seen in FIGS. 6B, 6D, 9 and 10, is connected to manifold assembly main housing 40*a* or 40*b*, and supports toggle link 46 such that one end 46*a* of toggle link 46 rests against an end of plunger 44*b* opposite from ball 44*a*, and a second opposite end 46*b* of toggle link 46 rests against an adjustment screw 49.

Adjustment screw 49 can be threaded farther into toggle mechanism housing 47 in order to create a pre-load through toggle link 46 onto plunger 44*b* and ball 44*a* against seat 41*a* of gas inlet 41.

In the embodiment shown in FIGS. 6B and 6D, end 46A is a separate eccentric member from end 46*b* of toggle link 46, and the two separate eccentric members contact each other along a knee joint 46*c*, as shown in FIG. 6B. Toggle link 46 provides a mechanical advantage in that only a relatively small load must be applied in a direction perpendicular to the central axis of plunger 44*b* along knee joint 46*c* in order to counteract a relatively large force created by high pressure gas along the axis of plunger 44*b*.

Referring to FIGS. 6A and 6C, a slide member 54 is slidably mounted within toggle mechanism housing 47 for reciprocating movement along a path perpendicular to the path traveled by gas release valve 44 when it moves from a closed to an open position.

As best seen in FIG. 6B, eccentric toggle link members 46*a* and 46*b* are confined between adjustment screw 49, gas release valve plunger 44*b*, and a lower surface 54*a* of slide member 54, when gas release valve 44 is in a closed position.

As best seen in FIGS. 6C and 6D, when slide member 54 is moved along a path perpendicular to the axis of gas release valve plunger 44*b*, opening 56 through slide member 54 is moved to a position over toggle link members 46*a* and 46*b*. In this position, toggle link members 46*a* and 46*b* are no longer restricted by lower surface 54*a* of slide member 54, and therefore pivot about knee joint 46*c* to enter into opening 56 through slide member 54, thus allowing gas release valve 44 to move to an open position.

Movement of slide member 54 from a position wherein lower surface 54*a* of slide member 54 restricts the movement of toggle link members 46*a* and 46*b*, to a position wherein toggle link members 46*a* and 46*b* can enter opening 56 through slide member 54, is effected by the actuation of solenoid 52. As best seen in FIGS. 9 and 10, solenoid 52 is supported on the manifold assembly by a bracket 48.

Actuation of solenoid 52 to move slide member 54 and open gas release valve 44, can only be effected upon the completion of an electrical circuit connecting solenoid 52 to a portable power source 60, as shown in FIG. 5. The completion of an electrical circuit providing electrical power to solenoid 52 also requires the closure of two interlock switches 62 and 64, and a tilt switch 70, as shown in FIG. 5.

Interlock switches 62 and 64 are provided as integral parts of vest closures 25*b* and 25*c*, such that closure of vest closures 25*b* and 25*c*, results in the closure of interlock switches 62 and 64. This inter-relationship between the electrical circuit providing power to solenoid 52 and the mechanical means for fastening the vest about a wearer, ensures that the vest cannot be accidentally inflated before it is properly installed on the wearer.

Tilt switch 70 provides the final electrical connection necessary to complete the electrical circuit that provides power from power source 60 to electric solenoid 52.

A tilt switch 70 provides a means for sensing a change in the orientation of the wearer of the vest, indicating that the wearer is approaching an abnormal position wherein the protection offered by the inflation of the bladders on the vest is required.

Figure 7:
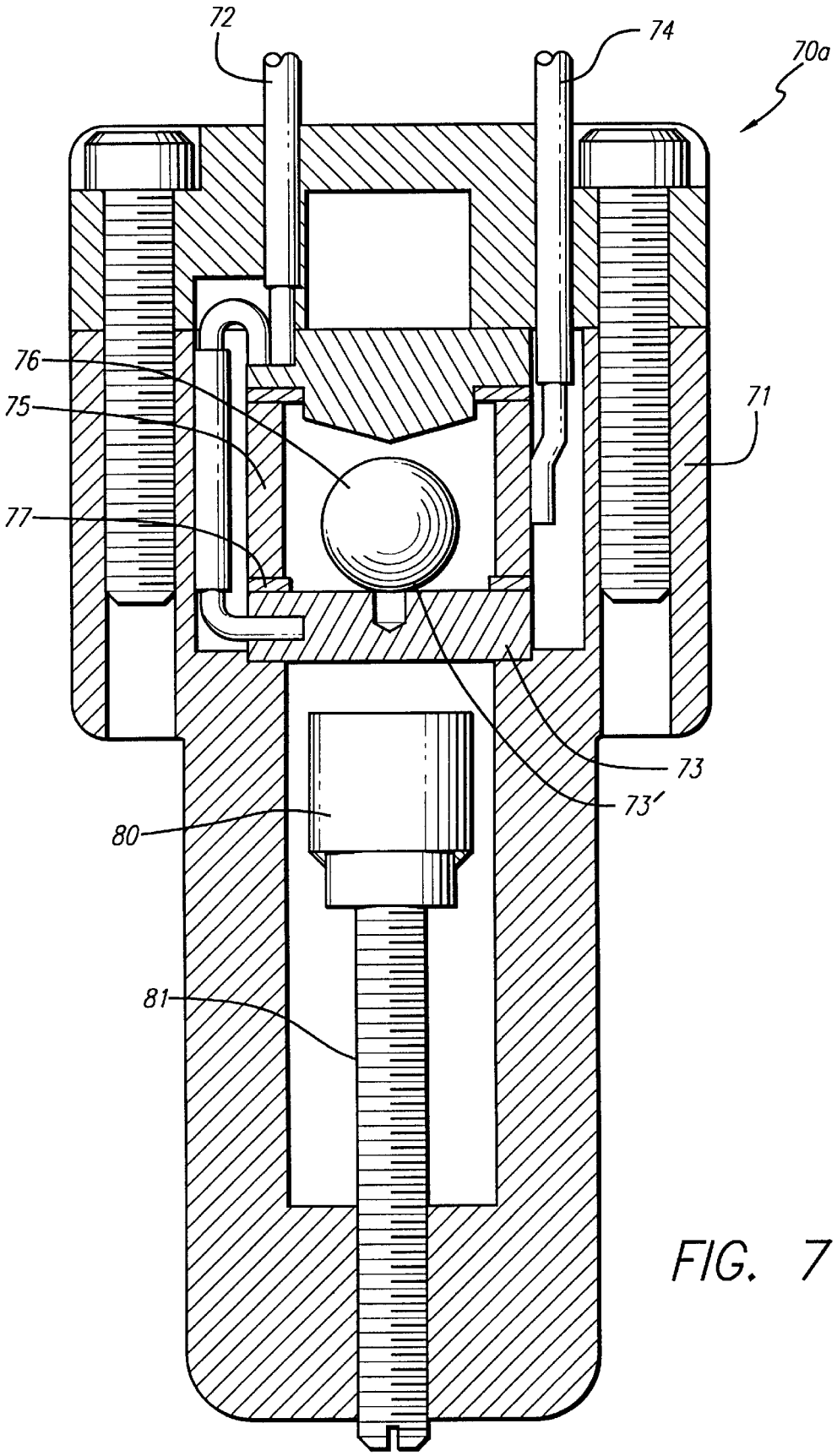
FIG. 7 is a side elevation view in partial cross-section showing one embodiment of a tilt switch for the present invention.

A first embodiment 70*a* of a tilt switch is shown in FIG. 7. A receptacle defined within the housing 71 of tilt switch 70*a* includes electrically conductive side walls 75 and electrically conductive lower walls 73 having a central concave depression 73' as shown in FIG. 7. Bottom wall 73 is electrically insulated from side wall 75 by insulation 77, as shown in FIG. 7. When a magnetically influenced ball 76 is positioned in depression 73', an open circuit exists between terminal 72 and 74 of tilt switch 70*a*. An abnormal change in orientation of the wearer of the vest results in electrically conductive ball 76 establishing electrical contact between bottom wall 73 and side wall 75. The degree of change in orientation required in order to cause ball 76 to complete the circuit between terminal 72 and 74 can be controlled by the positioning of a magnet 80 below bottom wall 73, as shown in FIG. 7. The distance between magnet 80 and ball 76 can be controlled by an adjusting screw 81 extending through housing 71 of tilt switch 70*a*. Magnet 80 exerts an attractive force on ball 76 in depression 73', thus resisting the movement of ball 76 to establish electrical contact between bottom wall 73 and side walls 75.

An alternative embodiment 70*b* of the tilt switch is shown in FIG. 8. Tilt switch housing 83 of tilt switch 70*b* defines a receptacle having a concave saucer-like depression at the bottom 86 of the receptacle, with a ball 82 contained within the receptacle and resting in the saucer-like depression of bottom 86. A miniature switch 90 is connected to housing 83 with an actuator 84 extending upwardly into the depression formed in bottom 86 of tilt switch 70*b*. When tilt switch 70*b* is in a normal orientation, ball 82 depresses actuator 84 of miniature switch 90, thus resulting in an open circuit. Movement of the wearer of the vest to an abnormal position would cause ball 82 to move away from miniature switch actuator 84, thus closing the circuit that provides power from portable power source 60 to electric solenoid 52, thus opening gas release valve 44 and providing gas to the inflatable bladders.

Although the present invention has been described in conjunction with several preferred embodiments, it is to be understood that modifications and variations can be made without departing from the scope of the claimed invention. For instance, the exact shape of the garment can be changed, and the number and orientation of inflatable compartments can be varied to conform to the shape of the garment. Additionally, the exact structure of the gas release valve could be changed from a two piece ball and plunger arrangement to single piece plunger having a concave end for contact with an O-ring seat at the gas inlet of the manifold assembly. The toggle mechanism could also be of any configuration that provides a mechanical advantage of the solenoid versus the pressure of gas. Furthermore, the tilt switch could be constructed using mercury as the medium for completing an electrical circuit when the wearer of the garment assumes an abnormal orientation. Accordingly, the afore-described embodiments are intended for the purpose of illustration and not as limiting the scope of the claimed invention.

Now that the invention has been described,

What is claimed is:

1. A protective inflatable vest comprising:

an inflatable bladder being attached to the vest;

a manifold assembly being attached to the vest, with the manifold assembly having a gas inlet and a gas outlet;

a pressurized gas canister being supported by said manifold assembly and providing pressurized gas to said gas inlet;

a gas release plunger being housed within said manifold assembly for reciprocation along a first path from a position wherein said plunger seals closed said gas inlet to a position wherein said plunger permits passage of pressurized gas from said gas inlet to said gas outlet;

tubing being attached to said vest and connecting said manifold assembly gas outlet to said inflatable bladder;

an electric solenoid;

reciprocating means operably connected to said electric solenoid for reciprocation along a second path substantially perpendicular to said first path;

a toggle link operably contacting said gas release plunger and said reciprocating means such that movement of said gas release plunger along said first path is prevented by said toggle link until said reciprocating means has moved along said second path;

a portable, electric power source; and a tilt switch electrically connected to said electric power source and said electric solenoid, said tilt switch being structured and disposed to operate from a normally open circuit position to a closed circuit position upon an angular change in orientation thereof to thereby deliver electric current from said electric power source to said electric solenoid, thereby actuating said electric solenoid.

2. A protective inflatable vest according to claim 1, wherein: said reciprocating means includes a slide assembly, said slide assembly having an opening therethrough and said slide assembly being housed within said manifold assembly for reciprocation along said second path; and said toggle link being housed within said manifold assembly and including a proximal end, a distal end and a knee joint intermediate said proximal and distal ends, said proximal end contacting said gas release plunger and said knee joint contacting said slide assembly such that movement of said gas release plunger along said first path is prevented by said toggle link until movement of said slide assembly along said second path places said opening through said slide assembly over said toggle link knee joint.

3. A protective inflatable vest according to claim 2, wherein:

said tilt switch is electrically connected in series to said portable, electric power source, and said tilt switch is electrically connected in series to said electric solenoid;

said electric solenoid is electrically connected in series through an interlock switch back to said power source; and said interlock switch being a part of a vest closure such that said interlock switch is placed in a closed position when said vest closure is closed.

4. A protective inflatable vest according to claim 3, wherein:

said tilt switch comprises a receptacle;

an electrically conductive magnetically influenced ball being housed within said receptacle;

said receptacle having an electrically conductive side wall connected to a first terminal of said tilt switch, and an electrically conductive end wall connected to a second terminal of said tilt switch with said end wall being electrically insulated from said side wall;

a portion of said electrically conductive end wall defining a concave depression for seating of said ball; and said tilt switch further including a magnet positioned in proximity to said end wall for attracting said ball to said concave depression.

5. A protective inflatable vest according to claim 3, wherein:

said tilt switch comprises a receptacle with a lower wall of said receptacle having a central concave depression;

a ball contained within said receptacle; and a switch actuator protruding into said central concave depression such that said ball maintains an open circuit when positioned within said central concave depression.

6. An impact absorbing garment comprising:

an inflatable compartment being integral to the garment;

a manifold assembly being supported on the garment, with the manifold assembly having a gas inlet and a gas outlet;

a pressurized gas canister being supported by said manifold assembly and providing pressurized gas to said gas inlet;

a gas release plunger being housed within said manifold assembly for reciprocation along a first path from a position wherein said plunger seals closed said gas inlet to a position wherein said plunger permits passage of pressurized gas from said gas inlet to said gas outlet;

gas conduit being supported on said garment and providing a passageway from said manifold assembly gas outlet to said inflatable compartment;

said manifold assembly further supporting an electric solenoid;

said electric solenoid being operably connected to a slide assembly;

said slide assembly having an opening therethrough and said slide assembly being slidably supported within said manifold assembly for reciprocation along a second path substantially perpendicular to said first path; and a toggle link being housed within said manifold assembly with said toggle link having a proximal end, a distal end and a knee joint intermediate said proximal and distal ends, said proximal end contacting said gas release plunger and said knee joint contacting said slide assembly such that movement of said gas release plunger along said first path is prevented by said toggle link until movement of said slide assembly along said second path places said opening through said slide assembly over said toggle link knee joint.

7. An impact absorbing garment according to claim 6, wherein:

said toggle link comprises separate proximal and distal link members supported within said manifold assembly.

8. An impact absorbing garment according to claim 6, further including:

a garment closure;

said garment closure having an electrical interlock switch that remains in an open position until said garment closure is closed.

9. An impact absorbing garment according to claim 6, further including:

at least two garment closures;

each of said garment closures having an electrical interlock switch that remains in an open position until said garment closure is closed.

10. An impact absorbing garment according to claim 9, further including:

means for sensing the orientation of a wearer of the garment;

a portable electric power source mounted on said garment; and said portable electric power source being electrically connected in series to said means for sensing the orientation of a wearer, said electric solenoid, and said electrical interlock switches.

11. An impact absorbing garment according to claim 10, wherein:

said means for sensing the orientation of a wearer comprises a trigger switch;

said trigger switch comprising a receptacle;

an electrically conductive magnetically influenced ball being housed within said receptacle;

said receptacle having an electrically conductive side wall connected to a first terminal of said trigger switch, and an electrically conductive end wall connected to a second terminal of said trigger switch with said end wall being electrically insulated from said side wall;

a portion of said electrically conductive end wall defining a concave depression of seating of said ball; and said trigger switch further including a magnet positioned in proximity to said end wall for attracting said ball to said concave depression.

12. An impact absorbing garment according to claim 10, wherein:

said means for sensing the orientation of a wearer comprises a trigger switch;

said trigger switch comprising a receptacle, with a lower wall of said receptacle having a central concave depression;

a ball contained within said receptacle; and a switch actuator protruding into said central concave depression such that said ball maintains an open circuit when positioned within said central concave depression.

13. An impact absorbing garment comprising:

front and back panels of flexible, open weave material that conforms to the shape of a torso of a wearer;

said front panel comprising a left and a right portion joined together by a plurality of garment closures;

said front and back panels each having grommets along their respective side edges;

lacing material being passed through said grommets to connect said front and back panels along their respective side edges;

a plurality of inflatable compartments being positioned along both of said front and back panels;

a manifold assembly supported on said garment, with said manifold assembly having a gas inlet and a gas outlet;

gas passageways being defined along the front and back panels and interconnecting said inflatable compartments and said manifold assembly gas outlet;

a pressurized gas canister being supported by said manifold assembly;

a gas release valve being supported by said manifold assembly in a position to control the opening of a passageway for high pressure gas from said gas canister to pass between said manifold assembly gas inlet and gas outlet; and a toggle link mechanism being mounted within said manifold assembly in conjunction with said gas release valve for reducing the force required to maintain said gas release valve in a closed position.

14. An impact absorbing garment according to claim 13, further including:

an electric solenoid mounted on said manifold assembly for releasing said toggle link mechanism to allow the opening of said gas release valve.

15. An impact absorbing garment according to claim 14, further including:

a portable power source mounted on said garment;

an interlock switch contained within at least one of said garment closures such that said interlock switch is placed in a closed position by closure of said garment closure;

a tilt switch mounted on said garment for sensing abnormal positions of a wearer of said garment; and said portable power source being electrically connected in series with said tilt switch, said interlock switch, and said electric solenoid.

16. An impact absorbing garment according to claim 15, wherein:

said toggle link mechanism includes a slide member having an opening therethrough, such that actuation of said electric solenoid moves said slide member to a position wherein a toggle joint enters into said opening and allows movement of said gas release valve to an open position.

17. An impact absorbing garment according to claim 16, wherein:

said tilt switch comprises a receptacle;

an electrically conductive ball being housed within said receptacle;

said receptacle having an electrically conductive side wall connected to a first terminal of said tilt switch, and an electrically conductive end wall connected to a second terminal of said tilt switch, with said end wall being electrically insulated from said side wall;

a portion of said electrically conductive end wall defining a concave depression for seating of said ball; and said tilt switch further including a magnet positioned in proximity to said end wall for attracting said ball to said concave depression.

18. An impact absorbing garment according to claim 16, wherein:

said tilt switch comprises a receptacle, with a lower wall of said receptacle having a central concave depression;

a ball contained within said receptacle; and a miniature switch actuator protruding into said central concave depression such that said ball maintains an open circuit when positioned within said central concave depression.

19. An impact absorbing garment according to claim 16, wherein:

said toggle joint comprises two separate eccentric members positioned end to end such that portions of each of said eccentric members enter into said slide member opening upon actuation of said electric solenoid.

20. An impact absorbing garment according to claim 13, further including:

an electric solenoid mounted on said manifold assembly for releasing said toggle link mechanism to allow the opening of said gas release valve;

said toggle link mechanism including a toggle joint and a slide member, with said slide member having an opening therethrough;

said toggle joint comprising two separate eccentric members positioned end to end such that portions of each of said eccentric members enter into said slide member opening upon actuation of said electric solenoid.

* * * * *